US005088566A

United States Patent [19]

Gustafsson et al.

[11] Patent Number: 5,088,566

[45] Date of Patent: Feb. 18, 1992

[54] HAND HELD HAMMER MACHINE

[75] Inventors: Klas R. L. Gustafsson, Kalmar; Ulf J. Lagne, Saltsjöbaden, both of Sweden

[73] Assignee: Berema Aktiebolag, Solna, Sweden

[21] Appl. No.: 604,765

[22] Filed: Oct. 26, 1990

[30] Foreign Application Priority Data

Oct. 28, 1989 [SE] Sweden ..... 8903620

[51] Int. Cl.[5] ..... B25D 9/04

[52] U.S. Cl. ..... 173/116; 173/134; 173/139

[58] Field of Search ..... 173/112, 116, 118, 119, 173/134, 135, 139, 128

[56] References Cited

U.S. PATENT DOCUMENTS

| | | | |
|---|---|---|---|
| 2,533,487 | 12/1950 | Maurer et al. | 173/116 |
| 2,638,749 | 5/1953 | Sparano | 173/116 |
| 3,650,336 | 3/1972 | Koehler | 173/139 |
| 4,203,446 | 5/1980 | Höfert et al. | 173/119 |
| 4,582,144 | 4/1986 | Mizutani | 173/119 |
| 4,609,053 | 9/1986 | Ragnmark | 173/109 |
| 4,611,670 | 9/1986 | Chromy | 173/116 |

*Primary Examiner*—Frank T. Yost
*Assistant Examiner*—Scott A. Smith
*Attorney, Agent, or Firm*—Eric Y. Munson; Mark P. Stone

[57] ABSTRACT

A hand held hammer machine comprises a housing (10) with a cylinder (11) therein, in which a reciprocating drive piston (40) via a gas cushion in a working chamber (44) repeatedly drives a hammer piston (15) to impact on the neck (17) of a tool (20) carried by the machine housing (10) as soon as a feeding force is applied via the machine housing (10) to the tool (20) and an interposed recoil spring (23) pre-stressed between fixed shoulders (28,22) in the housing (10) starts being compressed in response to tool penetration into the housing (10). Therein and within the spring (23) and around the path of movement of a piston rod (13) of the hammer piston (15) is affixed one end (26) of a sleeve (25), which by its other end forms a stop (30) limiting the penetration of the tool neck (17) into the machine housing (10) to a maximally allowable extent. The range of movements of the neck (17) wherein it can receive repetitive impacts lies between beginning and maximal compression of the spring (23) counted from its precompressed state which defines an idle position for the neck (17), and in that idle position and within that range proper uncovering of porting (45) in the cylinder wall is assured with the hammer piston seal (16) out of hazardous alignment with said porting (45) at the impacting instants.

10 Claims, 3 Drawing Sheets

36
37
34
35
32
33
43
11
42
53
40
44
45
16
14
10
46
47
13
15
12
23
28
27
17
38
29
19
18
21
20
51

HAND HELD HAMMER MACHINE

BACKGROUND OF THE INVENTION

The present invention relates to hand held hammer machines comprising a housing with a cylinder therein, in which a reciprocating drive piston via a gas cushion in a working chamber repeatedly drives a hammer piston to impact on and to return from the neck of a tool carried by the machine housing as soon as a feeding force is applied via the machine housing to the tool and spring means interposed therebetween are compressed.

In prior embodiments such machines, particularly if intended for heavy work such as breaking and of which one is described for example in EP publication 388.383 Al, are liable to the hazard of piston collision at application of too strong a feeding force. Such is the case when similarly to what may happen with pneumatic drills or breakers the operator erroneously believes being able to increase the working efficiency by hanging weights on the machine. Another inconvenience is that, although piston collision will be avoided at moderate overfeed, the hammer piston nevertheless will operate under disturbed conditions and at impact will fall in alignment with functionally important porting in the cylinder wall so that the hammer piston seal eventually will be damaged by the edges of said porting and piston leakage and work interruptions will occur. Another inconvenience is that the impact motor of the machine starts to pound as soon as the tool is applied against the surface to be worked upon. That means that the initial collaring or pointing from the very first contact with the working face has to be made under percussive action and, depending on the motor type often under full rotative motor speed, i.e. under full impact power, which makes it difficult to keep the tool exactly on the working spot aimed-at and also exposes the operator to injuries due to recoil and misdirected blows.

SUMMARY OF THE INVENTION

It is an object of the invention to provide means in the aforementioned type of machines that will limit the impacting range of the machine so the risks of piston collision and functional disturbances due to overfeed are eliminated. Concurrently therewith said means are apt to define an idle position for the hammer piston wherein collaring and pointing can be made with the machine running at a selective speed but with the hammer piston idle. These objects are attained by the characterizing features of the appended claims.

BRIEF DESCRIPTION OF THE DRAWINGS

The invention is described in more detail with reference to the accompanying drawings. Therein

DESCRIPTION OF THE PREFERRED EMBODIMENTS FOR CARRYING OUT THE INVENTION

Figure 1:
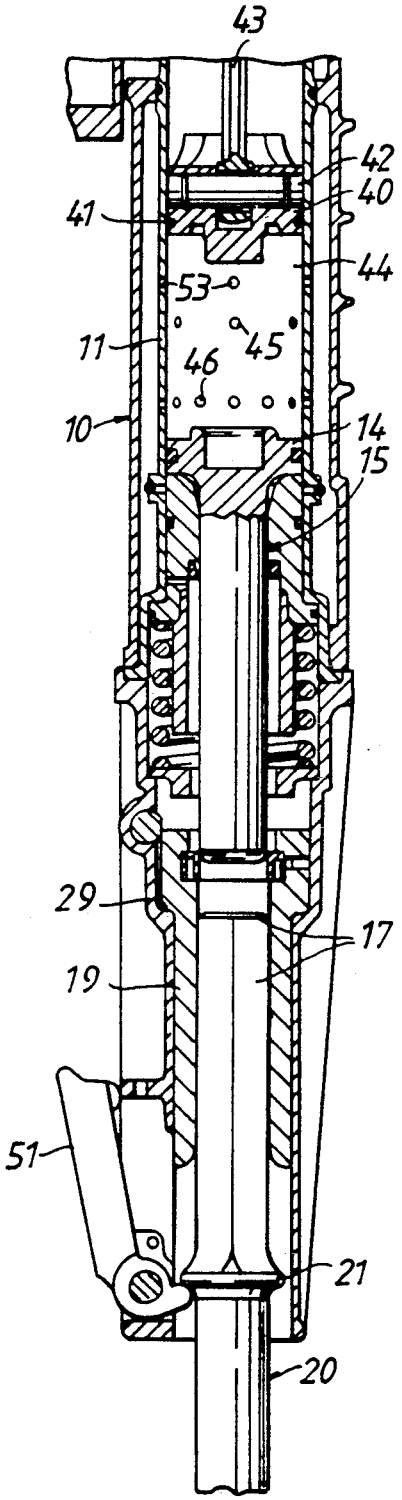
FIG. 1 shows a longitudinal partial section through a hammer machine embodying the invention, shown with its hammer piston in inactive position.
Figure 2:
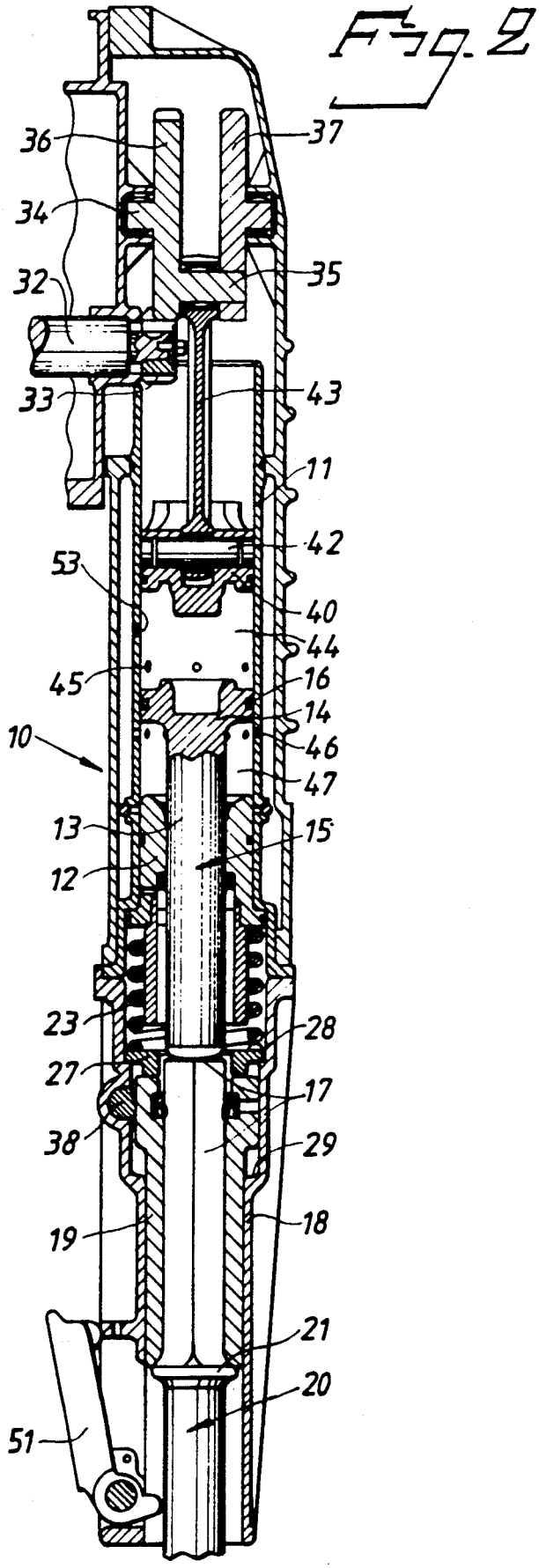
FIG. 2 shows a corresponding view with the hammer piston in idle or tool pointing position.

The hammer machine comprises a hand held machine housing 10 with a cylinder 11, in which a preferably differential hammer piston 15 is slidably guided and sealed by a piston ring 16 surrounding the piston head 14. The piston rod 13 passes slidably and sealingly through the bottom end or piston guide 12 and delivers impacts against the neck 17 of a tool 20, for example a pick, chisel, tamper or drill, which by a collar 21 rests axially against a tool sleeve 19 and is slidably guided therein. The sleeve 19 in its turn is axially slidably guided in the frontal end 18 of the housing 10, and when the work so demands is prevented from rotating by slidable contact of a plane surface thereon with a flattened cross pin 38 in the end 18. In the working position of FIG. 2 the sleeve 19 abuts against a spacing ring 27. A recoil spring 23 is pre-stressed between a shoulder 24 on a piston head 61 on the bottom end 12 and the spacer ring 27, urging the latter onto an inner shoulder 28 in the frontal end 18 (FIG. 3B) and the piston head 61 onto a rear shoulder 22. The pre-compression of the preferably helical spring 23 is such as to balance the weight of the machine when the latter is kept standing on the tool 20 as depicted in FIG. 2 or at least to provide a distinct resistance to beginning spring compression in such position. When the machine is lifted from said position, the tool sleeve 19 will sink down to inactive position against an abutment shoulder 29 in the frontal end 18, while the sinking movement of the tool 20 continues and is stopped by the collar 21 being arrested by the stop lever 51, FIG. 1. Simultaneously therewith the hammer piston 15 sinks down taking its inactive position in the foremost part of the cylinder 11.

The housing 10 comprises a motor, not shown, which, depending on the intended use, may be a combustion engine, an electric motor or a hydraulic motor. The motor drives a shaft 32 and a gear wheel 33 thereon is geared to rotate a crank shaft 34 journalled in the upper part of the machine housing 10. The crank pin 35 of the crank shaft 34 is supported by circular end pieces 36,37 of which one is formed as a gear wheel 36 driven by the gear wheel 33. A drive piston 40 is slidably guided in the cylinder 11 and similarly to a compressor piston sealed thereagainst by a piston ring 41. A piston pin 42 in the drive piston 40 is pivotally coupled to the crank pin 35 via a connecting rod 43. Between the drive piston 40 and the hammer piston head 14 the cylinder 11 forms a working chamber 44 in which a gas cushion transmits the movement of the drive piston 40 to the hammer piston 15.

Figure 3A:
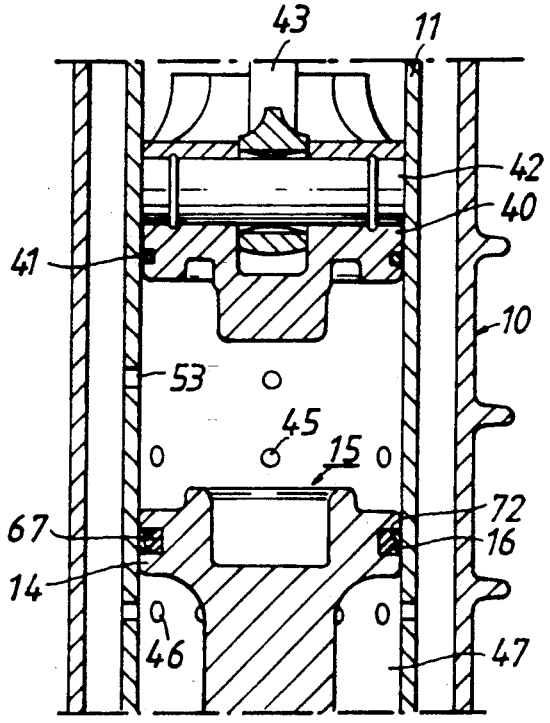
FIG. 3A is an enlarged section of the upper part of the impact motor in FIG. 2.
Figure 3B:
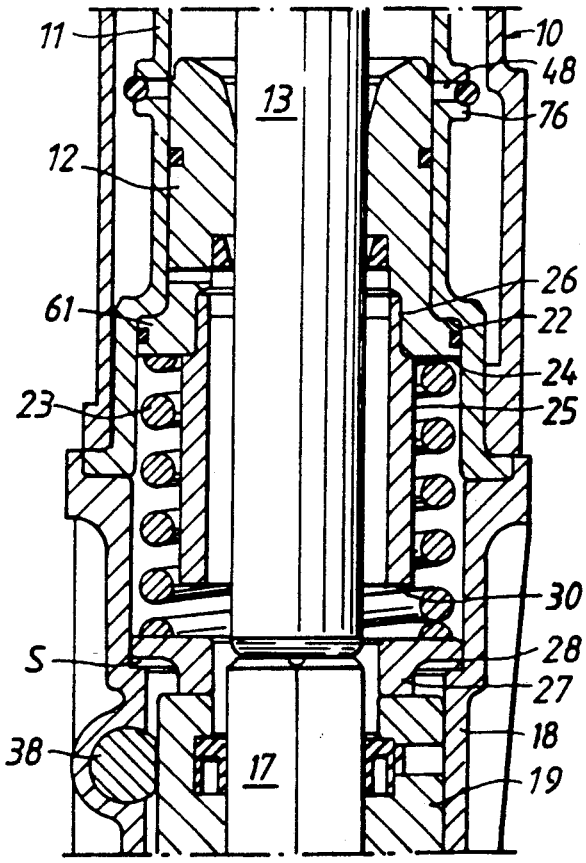
FIG. 3B shows, as a continuation of FIG. 3A, a corresponding view of the lower or frontal part of the impact motor.

The hammer piston head 14 has an annular peripheral groove 72, FIG. 3A, carrying the piston ring 16, undivided and of wear resistant plastic material such as glass fiber reinforced PTF((polytetrafluorethene), which seals slidably against the wall of the cylinder 11 in front of the drive piston 40. The piston ring 16 is sealed against the piston head 14 by an 0-ring of preferably heat resistant rubber which sealingly fills the gap therebetween. As an alternative, the piston head 14 may be machined to have a sealing and sliding fit in the cylinder 11, in which case the piston ring 16 and groove 27 are omitted.

The machine comprises a mantle 52 with the interior thereof suitably connected to the ambient air in a way preventing the entrance of dirt thereinto. The gas cushion in the working chamber 44 transmits by way of alternating pressure rise and vacuum the reciprocating movement of the drive piston 40 to the hammer piston 15 in phase with the drive generated by the motor and the crank mechanism. The working chamber 44 communicates with the interior of the machine through the wall of cylinder 11 via primary ports 45, FIG. 4, and secondary ports 46, FIG. 5. These ports 45,46 are peripherally and evenly distributed in two axially spaced planes perpendicular to the axis of the cylinder 11. The total area of the primary ports 45 is important for the idle operation of the machine and its transition from idling to impacting. The secondary ports 46 have only ventilating effect and their total area is greater, for example the double of the primary area as seen from FIGS. 4,5. Additionally there is provided a control opening 53 in the cylinder wall disposed between the lower turning point of the drive piston 40 and the primary ports 45. As seen from FIG. 2, the sealing portion of the hammer piston head 14, i.e. in the example shown the piston ring 16, in the idle position thereof is disposed intermediate the primary and secondary ports 45,46. The total ventilating area of opening 53 and primary ports 45 and the distance of the latter to the piston ring 16 are calculated and chosen such that the hammer piston 15 in its above-mentioned idle position is maintained at rest or under slight vibration without delivering blows while the overlying gas volume is ventilated freely through the ports and opening 45,53 during reciprocation of the drive piston 40 irrespective of its frequency and the rotational speed of the motor.

When starting to work, the operator, with the motor running or off, directs by suitable handles, not shown, the machine to contact the point of attack on the working surface by the tool 20 whereby the housing 10 slides forwardly and spacing ring 27 of the recoil spring 23 abuts on the tool sleeve 19, (FIG. 2). The operator selects or starts the motor to run with a suitable rotational speed and then applies an appropriate feeding force on the machine. As a result the recoil spring 23, the pre-compression of which has to be chosen strong enough to substantially balance the weight of the machine in its FIG. 2 position or to provide a marked resistance to spring compression, is compressed further, for example the distance S indicated in FIG. 3B, the hammer piston head 14 is displaced towards the primary ports 45, the ventilating conditions in the working chamber 44 are altered so as to create a vacuum that to begin with will suck up the hammer piston 15 at retraction of the drive piston 40. The suction simultaneously causes a complementary gas portion to enter the working chamber 44 through the control opening 53 so that a gas cushion under appropriate overpressure during the following advance of the drive piston 40 will be able to accelerate the hammer piston 15 to pound on the tool neck 17. The resultant rebound of the hammer piston 15 during normal work after each impact then will contribute to assure its return from the tool 20. Therefore, the percussive mode of operation will go on even if the feeding force is reduced and the machine again takes the FIG. 2 position on the tool 20. The control opening 53 is so calibrated and disposed in relation to the lower turning point of the drive piston 40 and to the primary ports 45, that the gas stream into and out of the control opening 53 in pace with the movements of the drive piston 40 maintains in the working chamber 44 the desired correct size of and shifting between the levels of overpressure and vacuum so as to assure correct repetitive delivery of impacts. The dimension and position of the control opening 53 and/or an increased number of such openings strongly influences the force of the delivered impacts. The secondary ports 46 ventilate and equalize the pressure in the volume below the piston head so that the hammer piston 15 can move without hindrance when delivering blows.

In order to switch from impacting to the idle hammer piston (15) position in FIG. 2 with the drive piston 40 reciprocating and the hammer piston 15 immobile, it is necessary for the operator to raise the hammer machine for a short distance from the tool 20 so that the neck 17 momentarily is lowered relative to the hammer piston 15 causing the latter to perform an empty blow without recoil. As a result the hammer piston 15 will take the inactive position of FIG. 1, the secondary ports will ventilate the upper side of the hammer piston 15 and impacting ceases despite the continuing work of the drive piston 40. Such mode of operation is maintained even upon the machine being returned to the balanced position thereof in FIG. 2 with the hammer piston head 14 returned to idle position between the ports 45,46.

Below the secondary ports 46 the cylinder 11 forms a braking chamber 47 for the hammer piston head 14. The chamber 47 catches pneumatically the hammer piston 15 in response to empty blows. Blows in the void are often performed so vehemently that the damping effect of the braking chamber 47 would become insufficient or the chamber 47 would be overheated. In order to cope with these effects and avoid harmful metallic bottom collisions, the bottom end 12 of the cylinder 11 is resiliently supported in the direction of impact against the action of the recoil spring 23 on which the bottom end 12 is supported by a shoulder 24 on the piston head 61 and maintained by the recoil spring 23 against the inner annular abutment shoulder 22 on the cylinder 11. By suitably arranged sealing rings the bottom end 12 is slidably sealed against the cylinder 11.

When at an empty blow the damping pressure in the braking chamber 47 is increased, the bottom end 12 is displaced resiliently downwardly and opens, similarly to the function of a check valve, throttling apertures 48 provided in an annular outwardly directed collar 76 on the cylinder 11. By their throttling action the apertures 48 are able to finally arrest the hammer piston 15 so that compressive overheating of chamber 47 and metallic collision are avoided. The spring returned check valve action of the bottom end 12 seals off the apertures 48 against gas return and the hammer piston 15 is kept caught in the braking chamber 47 until the vacuum condition created therein can be overcome by pressing up the tool 20 against the hammer piston 15 by application of the machine weight and/or of an appropriate feeding force.

Important for a safe return function is that the primary ports 45 are uncovered at the moment of impact. In order to assure that, a limit stop 30 is provided in the housing 10 in order to restrict the range wherein the tool neck 17 is exposed to repetitive impacts. That range extends from beginning displacement of the spacing ring 27 by the neck 17, FIG. 3B, i.e. when the recoil spring 23 due to application of a feeding force starts being compressed by said spacing ring 27, and is continued to the rear until the spacing ring 27 abuts against the limit stop 30. Said stop 30 is formed by one end of a sleeve 25 disposed around the hammer piston rod 13 inwardly of the recoil spring 23. The other end 26 of the sleeve 25 is connected to the housing 10, in the example shown being attached to the bottom end 12. At maximum compression of the spring 23 the spacing ring 27 thus is arrested by the limit stop 30 so that further compression is prevented. In such position the primary ports 45 are still open to gas ventilation above the sealing area of or the piston ring 16 on the hammer piston head 14. Due to the thus restricted impacting range, the piston ring 16 at the moment of impact will always be surrounded by cylinder wall portions free from through ports or openings liable to cause undesirable deformation and cutting of the piston ring 16.

The spacing ring 27 should be replaced by a lower ring if the hammer machine is to operate with tools having a shorter standardized neck portion. Furthermore the sleeve 25 in case of need can be mounted the other way round affixed to the spacing ring 27 and be driven to stop with the limit stop 30 in abutment with the bottom end 12 (piston head 61) without reduced safety.

The limit stop 30 is furthermore active also to restrict the yielding movement of said bottom end by abutting cooperation with the spacing ring in response to the hammer piston head 14 being caught in the braking chamber 47 at particularly strong empty blows.

We claim:

1. A hand held hammer machine comprising a housing; a cylinder in said housing; spring means in said housing at a forward end of said cylinder in alignment therewith and compressively supported on a frontal abutment in said housing; a limit stop in said housing; a tool and tool sleeve assembly axially movable in said housing relative to said cylinder at said forward end of said cylinder between a first position in which said tool and sleeve assembly further compresses said spring means away from said frontal abutment in response to axial movement of said tool and sleeve assembly towards said cylinder, and a second position in which said limit stop in said housing limits said movement of said tool and sleeve assembly towards said cylinder; a drive piston reciprocably movable in said cylinder at rear end of said cylinder; a hammer piston reciprocably movable in said cylinder between said drive piston and said tool and sleeve assembly; said hammer piston being driven by said drive piston through a working chamber defined in said cylinder between said drive piston and said hammer piston; portion means defined in a wall of said cylinder swept by said hammer piston during reciprocal movement of said hammer and drive pistons for providing fluid communication between ambient air and said working chamber so as to alternately reduce pressure in said working chamber to cause said hammer piston away from said tool, and to increase pressure to provide a gas cushion in said working chamber for driving said hammer piston to impact on said tool during movement of said drive piston towards said tool; said first and second positions of said tool and sleeve assembly being selected to define a range of movement of said hammer piston such that said hammer piston sweeps past and uncovers said porting means upon said impact of said hammer piston against said tool.

2. A hammer machine according to claim 1 wherein said spring means is a helical spring pre-compressed between said frontal abutment means and rear abutment means in said housing, said pre-compression of said helical spring being selected to balance the weight of the machine when the machine is kept standing on said tool.

3. A hammer machine according to claim 2, wherein said hammer piston is a differential piston including a piston rod, the piston rod being guided by a bottom end of said cylinder to impact on a tool of said tool and sleeve assembly, said frontal and rear abutment means being defined by opposed shoulders in said housing supporting said spring, said limit stop being defined by one end of a sleeve supported at its other end in said housing, said sleeve extending within said spring and around said piston rod, said second position of said tool and sleeve assembly being defined by the length of said sleeve.

4. A hammer machine according to claim 3, wherein said other end of said sleeve is affixed to said bottom end of said cylinder; and a spacer ring, actuatable by a tool sleeve of said tool and tool sleeve assembly, interposed between said spring and said frontal shoulder to first compress said spring and to subsequently abut against said limit stop during movement of said tool and tool sleeve assembly from said first position to said second position.

5. A hammer machine according to claim 4, wherein said other end of said sleeve is connected to said housing by said bottom end of said cylinder.

6. A hammer machine according to claim 4, wherein said other end of said sleeve is connected to said housing by said spacer ring.

7. A hammer machine according to claim 3, wherein said other end of said sleeve is connected to said housing by said bottom end of said cylinder, and said spring resiliently supports said bottom end axially relative to said cylinder, said limit stop limiting axial movement of said bottom end relative to said cylinder.

8. A hammer machine according to claim 1, wherein a sealing ring is provided on said hammer piston, said porting means comprising primary ports disposed in first a plane oriented transverse to the cylinder wall and adapted to be uncovered above said sealing ring upon impact of said hammer piston on said tool.

9. A hammer machine according to claim 8, wherein secondary ports are defined in said wall of said cylinder in a second plane oriented transverse to said cylinder wall, said second transverse plane being oriented closer to said tool than first transverse plane, said secondary ports ventilating the underside of said hammer piston during said reciprocal movement thereof, said first and second transverse plans being spaced relative to each other such that said sealing ring on said hammer piston is positioned in said cylinder between said primary and secondary ports upon impact of said hammer piston against said tool.

10. A hammer machine according to claim 1, wherein said tool and sleeve assembly comprises a tool having a neck, said neck being received in a tool sleeve that is axially movable in said housing, said tool sleeve cooperating with a spacer ring interposed between said spring means and said frontal abutment means to first compress said spring means by said spacer ring and to subsequently abut said spacer ring against said limit stop during movement of said tool and tool sleeve assembly from said first position to said second position.

* * * * *

UNITED STATES PATENT AND TRADEMARK OFFICE

CERTIFICATE OF CORRECTION

PATENT NO. : 5,088,566

DATED : February 18, 1992

INVENTOR(S) : Klaus Gustafsson et al

It is certified that error appears in the above-identified patent and that said Letters Patent is hereby corrected as shown below:

Column 5, Line 41 (Claim 1, Line 21):

Delete "portion" and substitute - -porting- -.

Signed and Sealed this

Twenty-ninth Day of June, 1993

*Attest:*

Michael K. Kirk

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,088,566

DATED : February 18, 1992

INVENTOR(S) : Klaus Gustafsson et al

It is certified that error appears in the above-identified patent and that said Letters Patent is hereby corrected as shown below:

Claim 1, Line 27 (Column 5, Line 47): After "piston", add - -to recede from said tool during movement of said drive piston- -.

Signed and Sealed this

Twelfth Day of October, 1993

Bruce Lehman

*Attest:*

BRUCE LEHMAN

*Attesting Officer*

*Commissioner of Patents and Trademarks*